US006119303A

United States Patent [19]

Passafiume

[11] Patent Number: 6,119,303

[45] Date of Patent: Sep. 19, 2000

[54] PAINT DRAINING GRID INCLUDING SQUEEGEES

[76] Inventor: Frank Passafiume, 17862 Princeton Cir., Strongsville, Ohio 44136

[21] Appl. No.: 09/449,160

[22] Filed: Nov. 24, 1999

Related U.S. Application Data

[60] Provisional application No. 60/110,117, Nov. 27, 1998, and provisional application No. 60/111,586, Dec. 9, 1998.

[51] Int. Cl.[7] ..... B65D 25/00; B44D 3/12

[52] U.S. Cl. ..... 15/257.06; 220/695; 220/702

[58] Field of Search ..... 15/257.05, 257.06; 220/570, 695, 700, 701, 702

[56] References Cited

U.S. PATENT DOCUMENTS

| | | | |
|---|---|---|---|
| 2,827,648 | 3/1958 | Geisz | 220/695 |
| 3,493,988 | 2/1970 | Tidwell | 15/257.06 |
| 4,145,789 | 3/1979 | Morgan, Sr. | 220/570 |
| 5,283,928 | 2/1994 | Linn | 15/257.06 |
| 5,695,098 | 12/1997 | King . | |
| 5,727,708 | 3/1998 | Erickson | 220/702 |
| 5,810,196 | 9/1998 | Lundy | 220/570 |

*Primary Examiner*—Randall E. Chin
*Attorney, Agent, or Firm*—Watts, Hoffmann, Fisher & Heinke, Co., L.P.A.

[57] ABSTRACT

A paint draining grid adapted to be inserted in a container of liquid that is suitable for application with a roller mounted on a conventional roller frame. The paint draining grid includes a frame having first and second spaced apart frame members wherein each bracket includes a hooked end portion for releasably attaching the paint draining grid to an upper rim of the container such that a grid member extends into an interior region of the container. The grid member includes a plurality of openings for permitting drainage of liquid and is secured between the first and second frame members. At least one squeegee, is affixed to each of the first and second frame members. The squeegee or squeegees affixed to the first frame member are positioned such that a paint roller rolled against the grid along a path of travel centered between the two spaced apart frame members would contact the squeegee or squeegees affixed to the first frame member to wipe liquid from one end of the roller and a roller support endcap adjacent the one end of the roller and the squeegee or squeegees affixed to the second frame member are positioned such that the paint roller rolled along the path of travel would contact the squeegee or squeegees affixed to the second frame member to wipe liquid from an opposite end of the roller and a roller support endcap adjacent the opposite end of the roller.

15 Claims, 3 Drawing Sheets

PAINT DRAINING GRID INCLUDING SQUEEGEES

The application claims benefit of Provisional Appl. 60/110,117 filed Nov. 27, 1998 and Provisional Appl. 60/111,586 filed Dec. 9, 1998.

FIELD OF THE INVENTION

This invention relates generally to a paint draining grid suitable for use with any liquid or solution applied with a paint roller and, more particularly, to a paint draining grid including a plurality of squeegees for wiping excess paint from the sides of a paint roller and the roller support endcaps adjacent the paint roller sides and wherein the paint draining grid is adapted to be releasably secured to an upper rim of a paint container.

BACKGROUND ART

Paint rollers are used for rapid paint application in both interior and exterior painting jobs. The roller or sleeve is rotatably mounted on a roller frame which includes a rotatable roller support and a handle. Paint is applied to the nap on the outer surface of the roller either by dipping the roller into a paint bucket with a wide enough mouth to accept the roller (e.g., a conventional 5 gallon plastic paint bucket) or dipping the roller into paint disposed in a paint tray.

One of the problems with using a paint roller in either of the above-identified situations is that invariably excess paint is left on the sides of the roller and on the endcaps of the roller support adjacent the roller sides. Such excess paint on the sides of the roller and roller support endcaps drips off as the roller is being moved from the bucket or tray to the surface to be painted. Paint continues to drip off the roller sides and roller support endcaps as the roller is being rolled over the surface to be painted. The excess paint adhering to the sides of the roller and roller support endcaps every time the roller is dipped or immersed in paint constitutes a continuing waste of paint.

Additionally, even when the roller is applied to the painting surface, the excess paint on the roller sides and roller support endcaps continues to be a problem for the painter. If the painter is painting a ceiling of a room, for example, the excess paint from the sides of the roller drips onto the painter, the roller frame handle, the painter's ladder and/or scaffolding, and areas of the room not intended to be painted such as the floor, walls, doors, windows, woodwork, etc., wasting additional paint and requiring the painter to expend time cleaning paint from himself or herself, his or her equipment and paint drops and splatters falling on areas of the room not intended to be painted. Even if painting a vertical wall, excess paint from the side of the roller and roller support endcaps drips down the wall requiring the painter to reroll over sections already painted to remove the drip lines. Paint may also drip down the roller frame onto the painter's hand and roller handle, again necessitating additional nonproductive clean up time by the painter.

What is needed is an apparatus for wiping excess paint from the sides of a paint roller and roller support endcaps when the roller is used by dipping the roller a paint container.

What is also needed is an apparatus for draining paint from the outer surface of a roller when the roller is used by dipping the roller in a paint container.

SUMMARY OF THE INVENTION

A paint draining grid including plurality of squeegees for wiping or removing excess liquid or solution, such as paint, from the sides of a paint roller is disclosed. The paint draining grid includes a grid or mesh having a plurality of liquid, such as paint, draining openings. The grid is support by a frame adapted to be hung on the upper edge or lip of a paint container, such as a 5 gallon paint bucket. The grid extends into the bucket. The frame further supports a plurality of flexible squeegees or wipers. The roller is immersed into paint in the container. As the roller is being removed from the bucket it is rolled along the grid, excess liquid, such as paint, from the outer surface of the roller drains through the plurality of openings in the grid and drips back into the paint. A width of the frame is sized such that as the roller is rolled along the grid to remove the excess paint from the roller, the sides of the roller brush at least one squeegee disposed on opposite sides of the grid. The squeegees wipe excess paint from the sides of the roller and endcaps of the roller support adjacent the roller sides. The paint wiped from the roller and roller support endcaps by the squeegees drops from the squeegees drips back into the paint.

Thus, the present invention facilitates removal of excess paint both from the roller outer surface and from the sides or ends of the roller as well as the roller support endcaps. Further, the present invention facilitates use of the paint roller directly with a paint container without the necessity of pouring the paint from the container into a paint tray.

These and other objects, advantages, and features of an exemplary embodiment of the present invention are described in detail in conjunction with the accompanying drawings.

DETAILED DESCRIPTION

Figure 1:
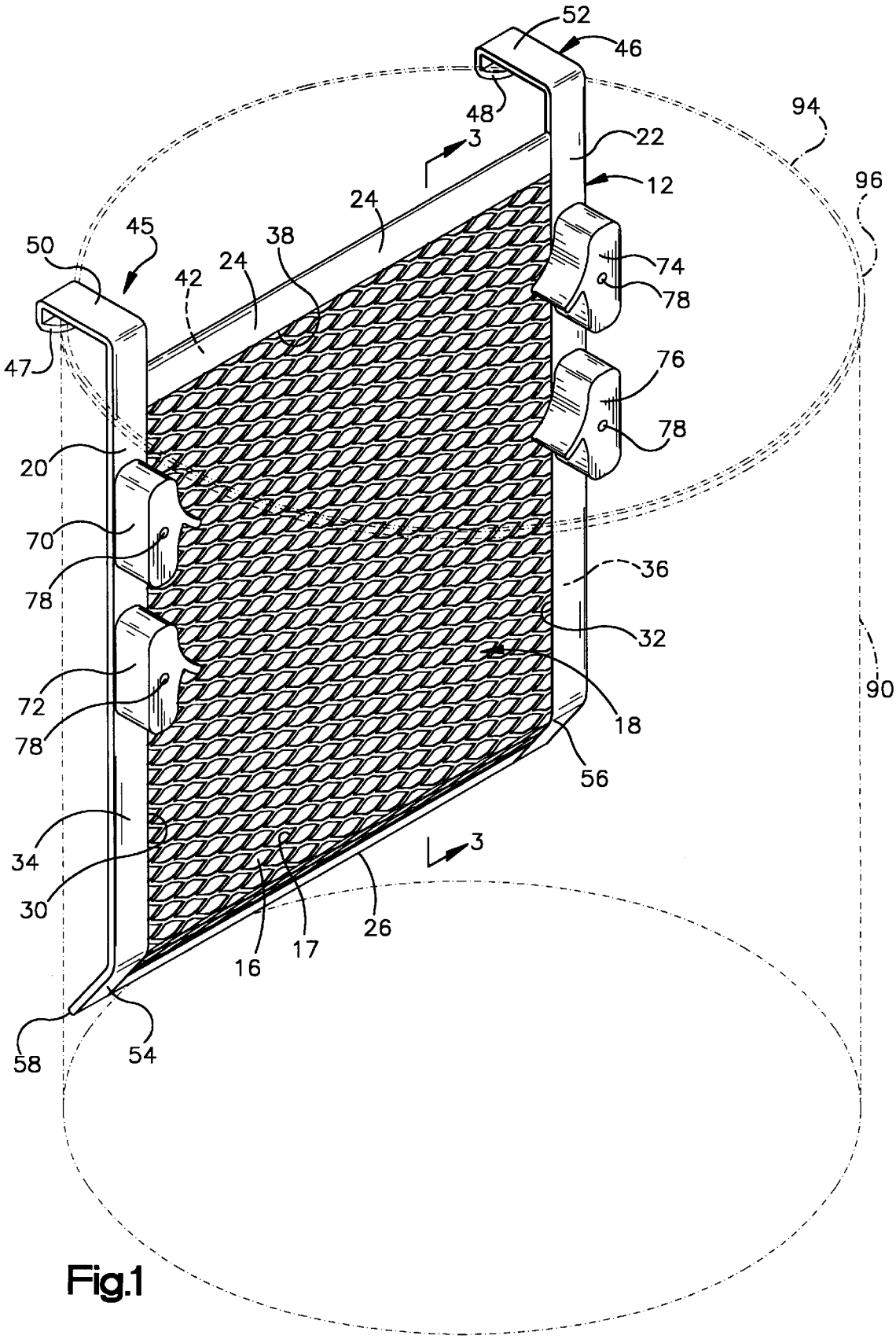
FIG. 1 is a perspective view of a preferred embodiment of the present invention comprising a paint draining grid including a plurality of squeegees, the paint draining grid adapted to hang on an upper rim or edge of a container and extend into the container.
Figure 2:
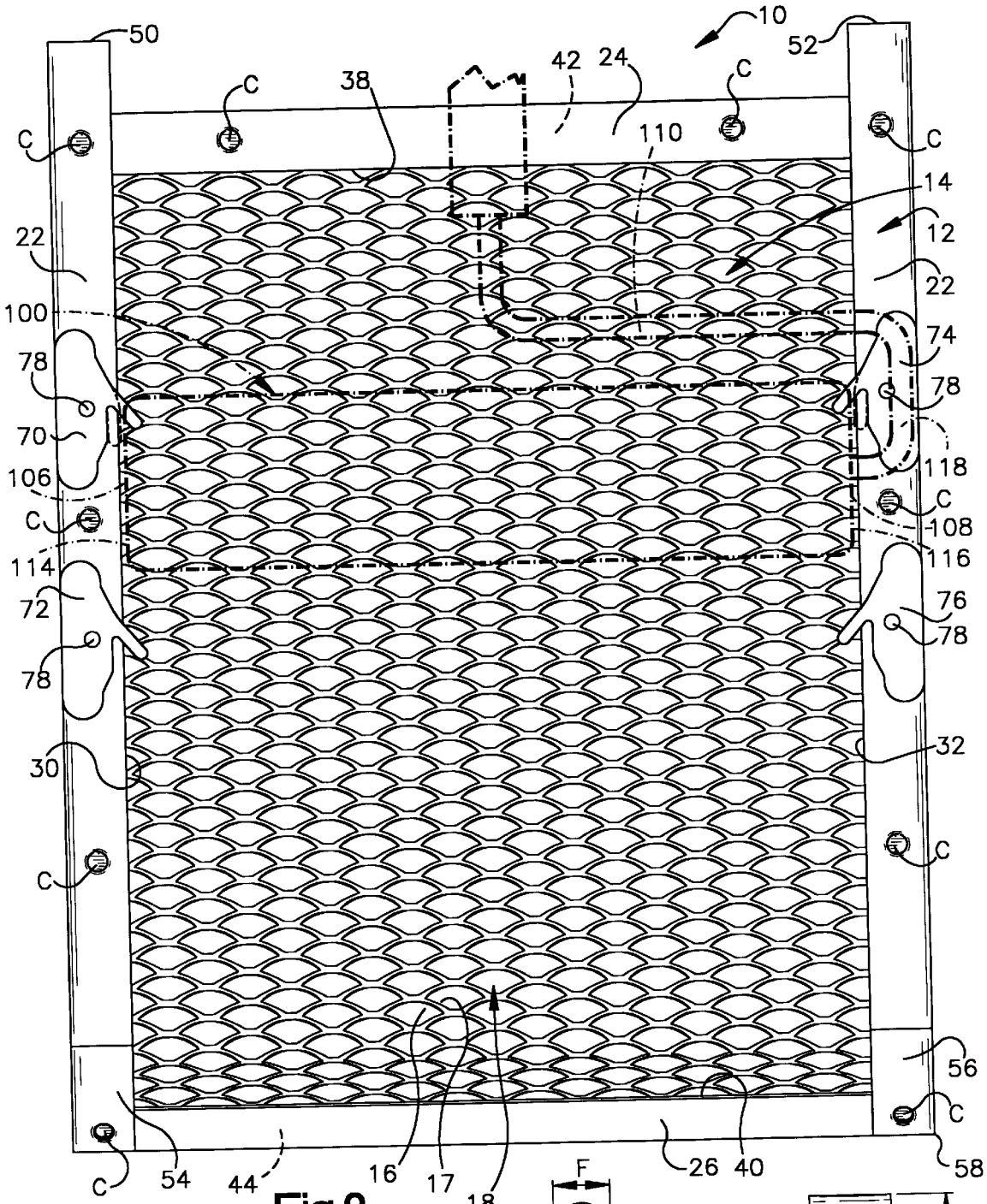
FIG. 2 is a front elevation view of the paint draining grid of FIG. 1 with a paint roller shown in dashed lines being rolled through the plurality of squeegees.

A first preferred embodiment of the paint draining grid of the present invention is shown generally at 10 in FIGS. 1 and 2. The paint draining grid 10 is adapted to be used with a container 90, such as a 5 gallon plastic bucket, and a conventional 9 inch wide paint roller 100 mounted on a paint roller frame 110. It should be noted that the paint draining grid 10 of the present invention is not in any way limited to use only with paint. Rather, the paint draining grid 10 may advantageously used with any liquid, solution, emulsion, etc. that is suitable for application with a roller or sleeve mounted on a conventional paint roller frame. When the terms "paint" "paint container" or "paint roller" are used herein, it should be understood that the term "paint" is being used broadly to refer to any liquid, solution, emulsion, etc. suitable for application with a roller or sleeve mounted on a conventional paint roller frame.

Figure 3:
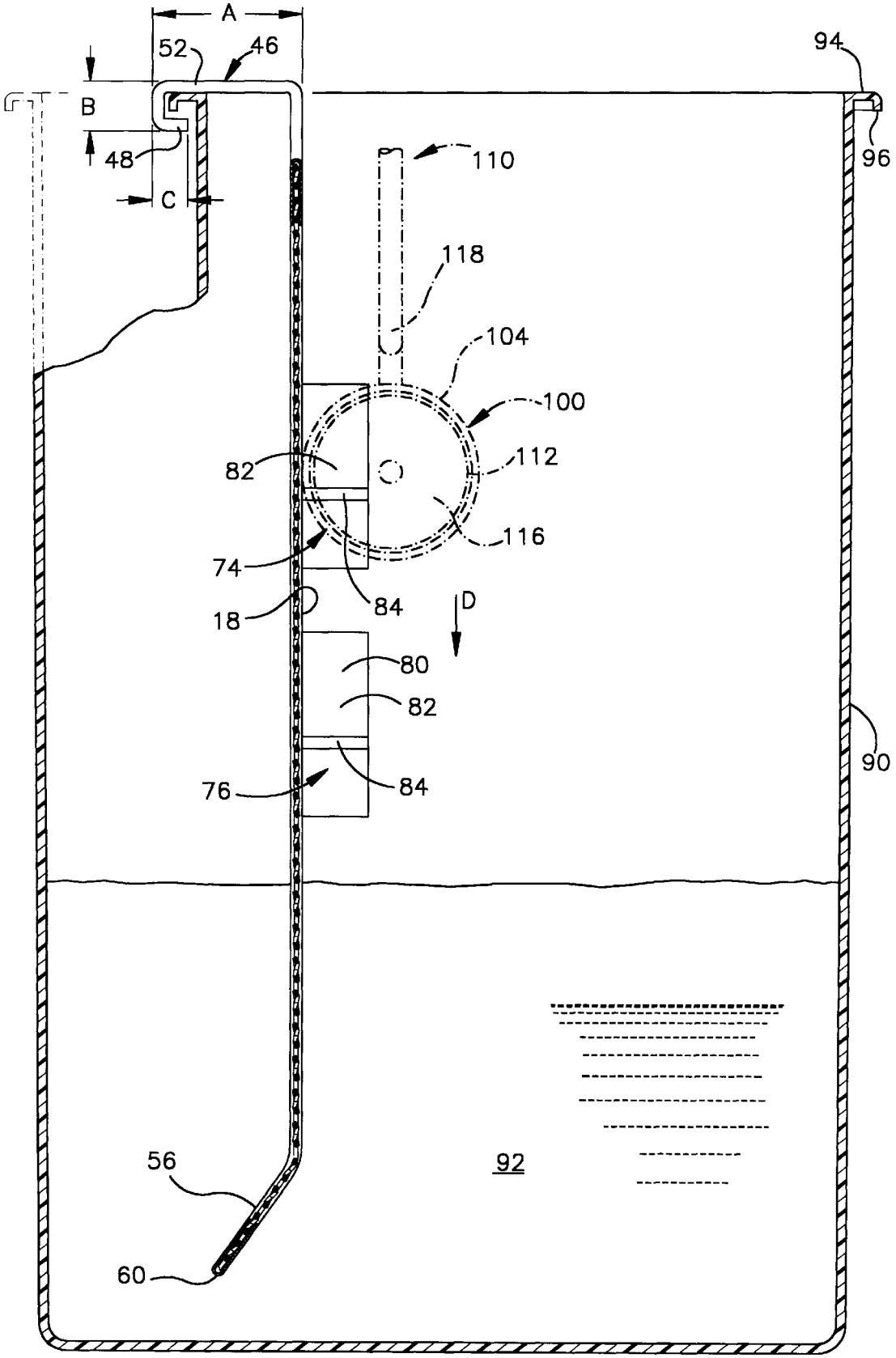
FIG. 3 is a sectional side elevational view as seen from a plane indicated by the line 3—3 in FIG. 1 with a paint roller shown in dashed lines being rolled through the plurality of squeegees.

As can best be seen in FIG. 3, for proper use of the paint draining grid 10, the quantity of paint 92 in the paint container 90 must be less than completely full, preferably, the quantity of paint 92 is about ½ (or less) of the capacity of the container 90.

Advantageously, the paint draining grid 10 of the present invention simultaneous provides for removal of excess paint from an outer surface or nap 104 of the roller 100 via a grid member 14 and removal of excess paint from opposite sides or ends 106, 108 of the roller 100 and from endcaps 114, 116 of a rotatable roller support member 112 that supports the roller 100. After the paint roller 100 has been dipped or immersed in the paint 92, a painter rolls the roller 100 in a downward direction D against the grid member 14 thereby removing excess paint from the outer surface nap 104 of the roller 100.

As the roller 100 moves along its path of travel in a downward direction labeled D in FIG. 3 on the grid member 14, four squeegees 70, 72, 74, 76 wipe against the sides 106, 108 of the roller 100 and the roller support member endcaps 114, 116 adjacent the roller sides 106, 108 to wipe excess liquid, such as paint, from the roller sides and the roller endcaps. The squeegees 70, 72 wipe excess liquid, such as paint, from the roller side 106 and roller endcap 114 while the squeegees 74, 76 wipe excess liquid, such as paint, from the roller side 108 and roller endcap 116. The paint draining grid 10 of the present invention is suitable for use with a variety of thickness of the roller nap 104 from ¼" to 1 inches thick nap.

Grid Member 14

The paint draining grid 10 comprises a frame 12, preferably a sheet metal channel fabricated of 0.03 inch thick rust-resistant metal such as galvanized steel, supporting a grid or mesh member 14 fabricated of 0.02 inch thick rust resistant metal such as galvanized steel. The grid member 14 is commonly referred to as expanded metal which may be fabricated by stretching a strip of metal having a series of slits that, upon stretching expand into diamond shaped openings 16. Although it should be recognized that other methods of fabricating the grid member 14 known to those skilled in the art are also suitable. The grid member 14 defines a plurality of openings 16 for liquid, such as paint, to drain through. Preferably, the openings 16 are diamond shaped with each side of a diamond opening being approximately ½ inch in length. The grid member 14 comprises intersecting strips 17 of galvanized metal approximately 1/16 inch in width. The openings 16 are regularly spaced creating a matrix or an array of pain draining openings.

The strips 17 of the grid member 14 are angled at approximately 45° with respect to a planar extent of the grid 14 to facilitate excess paint removal from the outer surface nap 104 of the paint roller 100 as the roller is press against an upper working surface 18 of the grid member 14 and rolled downwardly. The excess paint is squeezed from the roller outer surface nap 104 as the roller is pressed against and rolled down the grid upper working surface 18. The excess paint flows through the grid member openings 16 and runs along the grid and/or drips downwardly back into the remaining paint 92 in the container 90. Depending on how much paint the painter wishes to remove from the roller nap 104, the painter may repeat the process of rolling the roller 100 down the grid member 14 two, three or more times.

At least a portion of the grid member 14 must be disposed above the paint level in the container 90 so that the roller 100 can be rolled against a portion of the grid member 14 not immersed in paint. To remove excess paint from the roller nap 104 by rolling the roller 100 against the grid member 14, the contact between the roller nap 104 and the grid member 14 must be done on a section of the grid member 14 above the paint 92, this is the reason that the quantity of paint 92 initially in the container 90 must be significantly less than the capacity of the container 90.

Frame 12

The frame 12 consists of two parallel L-shaped sheet metal channels 20, 22 and a pair of cross member sheet metal channels 24, 26 which provide a support frame for the grid member 14. The first and second channels 20, 22 and first and second cross member channels 24, 26 are fabricated by forming pieces of 1 inch wide, 0.030 inch thick galvanized sheet metal into a U-shaped channel. The L-shaped sheet metal channels 20, 22 are approximately 13½ inches in overall length and are formed into a U-shape (about ½ inch in width) defining respective slots 30, 32. Longitudinal peripheral edges 34, 36 of the grid member 14 fit into the slots 30, 32.

The cross member sheet metal channels 24, 26 are approximately 9¾ inches in overall length and are formed into a U-shape (also about ½ inch in width) defining respective slots 38, 40. Transverse or lateral peripheral edges 42, 44 of the grid member 14 fit into the slots 38, 40. The grid member 14 is secured to the L-shaped channels 20, 22 and the cross member channels 24, 26 and the channels are secured to each other by pressing together or crimping the channels at the points labeled as C. The grid member 14 is approximately 11 inches in length and 9¾ inches in width.

Hooked End Portions 45,46

As can best be seen in FIG. 3, extending hooked end portions 45, 46 of the L-shaped lengthwise channels 20, 22 are bent to hang over an upper edge or rim 94 of the paint container 90. Advantageously, inwardly bent distal tips 47, 48 of the hooked end portions 45, 46 are J-shaped to hook under an outwardly extending collar 96 adjacent the upper rim 94 of the container 90. The tips 47, 48 and the upper flat sections 50, 52 of the hooked end portions 45, 46 together releasable secure the paint draining grid 10 to respect to the container 90 and prevent it from being moved vertically upwardly or downwardly as the roller 100 is moved along its downward path of travel D against the grid member 14. Suitable dimensions for the hooked end portions 45, 46, labeled in FIG. 3, are as follows:

| Label | Dimension |
|---|---|
| A | 1 7/16 inch |
| B | ⅜ inch |
| C | ¼ inch |

Additionally, lateral support for the portion of the paint draining grid 10 extending into the container 90 is provided by lower angled portions 54, 56 of the L-shaped channels 20, 22. The length of the lower angled portions 54, 56 is approximately 2 inches and is at an angle of approximately 45 degrees. Outer edges 58, 60 of the lowered angled portions abut an inner wall of the container 90 to the grid member 14 from pivoting or moving from its near vertical orientation as the roller 100 is rolled against the grid member 14. When the paint draining grid 10 is inserted in the container 90, the grid member working surface 18 is tilted slightly toward the user, the grid member 14 being closer to the inner wall of the container at the top than at the bottom to make it easier for the painter to roll the roller 100 against the grid member 14 than if the grid member were perfectly vertically oriented.

Squeegees 70, 72, 74, 76

Key to the paint draining grid 10 of the present invention is the provision of the plurality of squeegees 70, 72, 74, 76 adapted to wipe paint from opposite ends or sides 106, 108 of the roller 100 and the roller support member endcaps 114, 116 as the roller 100 is rolled downwardly along its path of travel against the grid member 14. In one preferred embodiment, four squeegees are provided, however, it should be recognized that providing at least one squeegee on each side of the grid member 14 above the level of paint 92 in the container 92 is sufficient for the present invention to properly perform the paint wiping function provided that the painter rolls the roller 100 on the grid member 14 a plurality of times.

Each squeegee 70, 72, 74, 76 is affixed to its respective L-shaped channel 20, 22 by a ¾ inch metal Phillips head screw 78 which passes through an aperture in the channel and into a mounting or base portion 80 of the squeegee. It should be recognized, however, that a valiety of attachment mechanisms known to those skilled in the art may also be used such as adhesive, nut and bolt, press fit between extending portion of mounting portion of squeegee and slot or opening of channel or vice versa, clamp, etc. Also, each squeegee may be configured such that the squeegee may be attached directly to the grid member 14 using a suitable attachment structure thereby eliminating the need for portions or all of the frame 12.

Each squeegee includes the rigid mounting portion 80 and a resilient, flexible paint wiping portion 82 that is angled downwardly at about a 45° angle with respect to a longitudinal axis L. The pair of squeegees 70, 74 facing each other are horizontally aligned (perpendicular to longitudinal axis L) as are the opposing squeegee pair 72, 76. The horizontal distance between distal tips 84 of the squeegee pair 70, 74 is approximately 9 inches as is the distance between distal tips 84 of the squeegee pair 72, 76. Each squeegee 70, 72, 74, 76 has a height of approximately ½ to 1 inch, preferably ¾ inch, above the upper surface of its respective L-shaped channel 20, 22.

The height of a squeegee is critical because the higher the squeegee above the channel, the greater the area of the paint wiped from the roller sides 104, 106 and the roller support endcaps 114, 116 by a squeegee. However, if the height of a squeegee is too high it will "catch on" or interfere with a portion 116 of the roller frame 110 as the roller 100 rolls along the grid member 14. The roller frame portion 116 functions as the axle on which the roller support member 112 and roller 100 rotate. The ¾ inch height of a squeegee has been found to be a good compromise that wipes about ⅓ of the area defined by a roller side and roller support endcap while not substantially interfering with the roller frame portion 116 as the roller 100 rolls against the grid member 14. As noted above, the height of the squeegees are suitable for wiping rollers having naps 104 with nap thickness varying between ¼ inch and 1 inch.

Additionally, the use of two appropriately spaced apart squeegees on each L-shaped channel 20, 22 means that in one downward movement of the roller 100 on the grid member 14, about ⅔ of the area defined by a roller side and roller support endcap is wiped clean. This is sufficient to markedly reduce dripping paint from the roller sides 104, 106 and roller support endcaps 114, 116. Moreover, if the roller 100 is rolled on the grid member 14 more than once, as most painters will do to remove excess paint from the roller nap 104, the wiping or cleaning of the roller sides 104, 106 and roller support endcaps 114, 116 by the squeegees 70, 72, 74, 76 is even better.

The distance between the mounting screws of squeegees 70, 72 along channel 20 is 2½ inches. Similarly, the distance between the mounting screws of squeegee pair 74, 76 along channel 22 is 2½ inches. Additionally, the respective distances between the upper flat portions 50, 52 of the hooked end portions 45, 46 and the mounting screws 78 of the upper squeegees 70, 74 is approximately 3 inches. The respective distances between the mounting screws 78 of the upper squeegees 70, 74 and bends defining the start of the lower angled sections 54, 56 of the L-shaped channels 20, 22 is approximately 4¼ inches. Positioning of the squeegees closer to the upper rim 94 of the container 90 permits a higher level of paint 92 to be put in the container without interfering with the wiping action of the squeegees.

Figure 4:
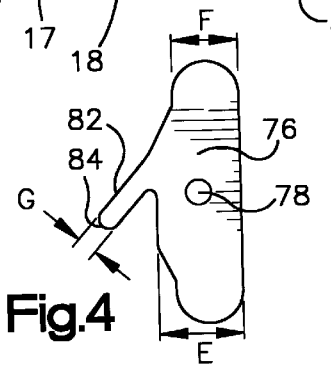
FIG. 4 is a front elevation view of one squeegee of the paint draining grid.
Figure 5:
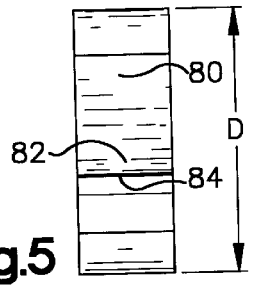
FIG. 5 is a side elevation view of the squeegee of FIG. 5.

FIGS. 4 and 5 illustrate one of the squeegees 70. Suitable dimensions, labeled on FIGS. 5 and 6 are as follows:

| Label | Dimension |
|---|---|
| D | 1½ inch |
| E | ⅜ inch |
| F | ¼ inch |
| G (thickness of wiping portion) | 1/32 inch |

Each squeegee 70, 72, 74, 76 may be formed of any suitable material, such as rubber. A thickness of the flexible wiping portion 82 (1/32 inch) should be thin enough to provide flexibility while thick enough to be resilient. Flexibility is needed such that the squeegee wiping portion will flex downwardly as the roller side contacts the wiping surface. Resiliency is needed such that the squeegee wiping portion 82 will press against the roller side and roller support endcap as the roller passes the squeegee thereby insuring that the paint wiping surface of the wiping portion will contact and wipe excess paint from the roller side. Resiliency is also need to return the squeegee wiping portion 82 to its original position or orientation after the roller side has passed the squeegee.

Although illustrated with four squeegees in specific locations along a length of the channels 20, 22, it should be understood that the present invention is not limited to four squeegees. The use of one squeegee affixed to each channel 20, 22 would be sufficient to wipe a substantial portion of excess paint from the roller sides and roller support endcaps, especially given the fact that most paints will roll the roller 100 over the grid member 14 more than once. Similarly, use of more than four squeegees is also contemplated by the present invention. Nor do the squeegees on opposite channels necessarily have to be positioned in horizontal alignment. Squeegees may be positioned in any suitable locations along the L-shaped channels 20, 22.

While the preferred embodiment of the present invention has been described with a degree of particularity it is the intent that the invention include modifications from the disclosed design falling within the spirit or scope of the appended claims.

What is claimed is:

1. A paint draining grid adapted to be inserted in a container defining an interior region for holding a quantity of liquid, having an upper rim and a collar extending outwardly from the upper rim, the paint grid comprising:

a) a frame including first and second spaced apart frame members, each frame member including a hooked end portion for releasably attaching the paint draining grid to the upper rim of the container such that the grid frame extends into the container interior region;

b) a grid member disposed between the first and second frame members, the grid including a plurality of openings sized to permit drainage of liquid through the plurality of openings;

c) at least one squeegee affixed to each of the first and second frame members, the at least one squeegee affixed to the first frame member positioned to contact a first end of a paint roller rolled against the grid member along a path of travel centered between the first and second frame members to wipe liquid from the first end of the roller and the at least one squeegee affixed to the second frame member positioned to contact an opposite end of the paint roller rolled against the grid member along the path of travel to wipe liquid from the opposite end of the roller.

2. The paint draining grid of claim 1 wherein a first squeegee and a spaced apart second squeegee are affixed to the first frame member and a first squeegee and spaced apart second squeegee are affixed to the second frame member, the first and second squeegees affixed to the first frame member being aligned horizontally with the first and second squeegees affixed to the second frame member.

3. The paint draining grid of claim 2 wherein a horizontal distance along the grid member between a wiping surface of the first squeegee of the first frame member and a wiping surface of the first squeegee of the second frame member is 9 inches.

4. The paint draining grid of claim 1 wherein the frame further includes first and second spaced apart cross members extending laterally between the first and second frame members, the first cross member being adjacent a first end of the grid member and the second cross member being adjacent a second end of the grid member.

5. The paint draining grid of claim 4 wherein the first and second frame members and the first and second cross members are fabricated of sheet metal strips bent to form U-shaped channels defining slots and wherein respective peripheral edges of the grid member fit into the respective slots of the first and second frame members and the first and second cross members.

6. The paint draining grid of claim 4 wherein the grid member extends at least 9 inches between the first and second cross members.

7. The paint draining grid of claim 5 wherein the grid member is secured in the respective slots defined by the first and second frame members and the first and second cross members by crimping.

8. The paint draining grid of claim 1 wherein each of the squeegees is affixed to its respective frame member such that an extending wiping surface of the squeegee is transverse to its respective frame member.

9. The paint draining grid of claim 8 wherein the wiping surface of each of the squeegees is perpendicular to its respective frame member.

10. The paint draining grid of claim 1 wherein each of the squeegees includes a mounting portion and a wiping portion, the mounting portion secured to its respective frame member by a screw.

11. The paint draining grid of claim 1 wherein the hooked end portions of the first and second frame members include respective angled distal portions that are sized to engage a bottom surface of the collar of the container while flat upper sections of the hooked end portions abut the container upper rim thereby constraining vertical movement of the paint draining grid with respect to the container as the paint roller is rolled along the path of travel along the grid member and the ends of the roller are wiped by the squeegees.

12. The paint draining grid of claim 1 wherein the grid member comprises a mesh including an array of openings for liquid drainage through the grid.

13. The paint draining grid of claim 1 wherein the grid member and the first and second frame members are fabricated of galvanized steel for rigidity and corrosion resistance.

14. The paint draining grid of claim 1 wherein the roller is supported on a roller frame including first and second roller support endcaps adjacent the first end of the roller and the at least one squeegee affixed to the first frame member wiping liquid from the first endcap and the at least one squeegee affixed to the second frame member wiping liquid from the second endcap as the paint roller rolls against the grid member along the path of travel.

15. The paint draining grid of claim 1 wherein the at least one squeegee affixed to each of the first and second frame members extends above the respective first and second frame members a distance of between ½ and 1 inch.

* * * * *